United States Patent [19]

Eheim, deceased

[11] Patent Number: 4,791,901

[45] Date of Patent: Dec. 20, 1988

[54] RPM GOVERNOR FOR FUEL INJECTION PUMPS

[75] Inventor: Franz Eheim, deceased, late of Stuttgart, Fed. Rep. of Germany, by Helga Eheim, legal representative

[73] Assignee: Robert Bosch GmbH, Stuttgart, Fed. Rep. of Germany

[21] Appl. No.: 759,784

[22] Filed: Jul. 29, 1985

[30] Foreign Application Priority Data

Aug. 22, 1984 [DE] Fed. Rep. of Germany ..... 3430797

[51] Int. Cl.[4] ..... F02M 39/00

[52] U.S. Cl. ..... 123/373; 123/449; 123/359

[58] Field of Search ..... 123/357–359, 123/449, 373, 365, 364

[56] References Cited

U.S. PATENT DOCUMENTS 4,387,688 6/1983 Eheim ..... 123/179 L
4,432,319 2/1984 Yasohara ..... 123/357
4,502,439 3/1985 Nagase ..... 123/357
4,509,470 4/1985 Ito ..... 123/179 L
4,519,352 5/1985 Eheim et al. .
4,616,616 10/1986 Staniak ..... 123/357

FOREIGN PATENT DOCUMENTS 0093939 6/1983 Japan ..... 123/357

*Primary Examiner*—Carl S. Miller
*Attorney, Agent, or Firm*—Edwin E. Greigg

[57] ABSTRACT

An rpm governor for fuel injection pumps of internal combustion engines, having a pivotable spring tensioning lever which is engaged by an rpm signal transducer counter to the force, acting as the guide variable, of a governor spring and on which a pivot shaft following up the adjusting movement of the tensioning lever, of a two-armed transmission lever is disposed. The transmission lever is articulated on a quantity control member and is pivoted via an electrical adjusting motor. The adjusting motor is triggered by an electrical control unit, which processes engine and environmental parameters and effects a correction of the injection quantity.

18 Claims, 3 Drawing Sheets

FIG. 1
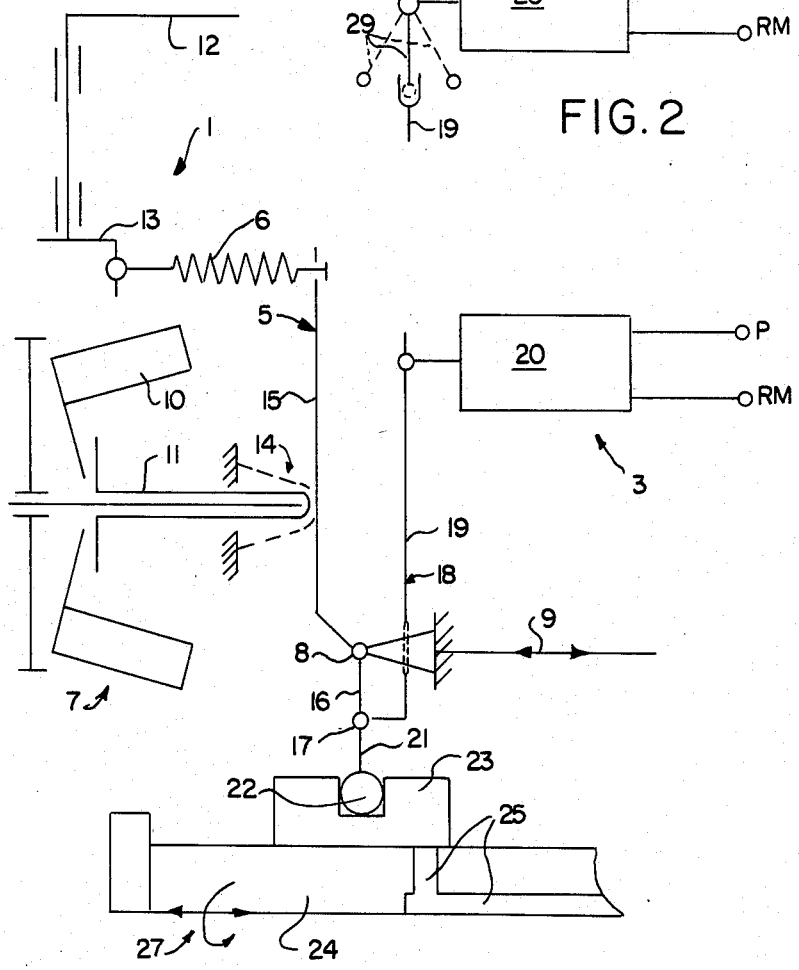
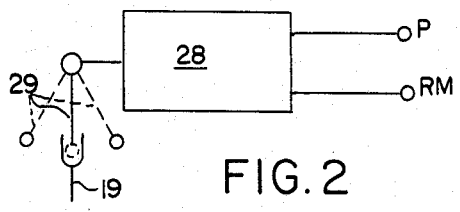
FIG. 2
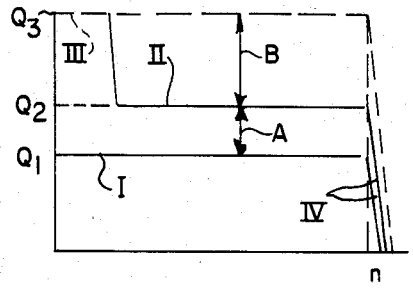
FIG. 3

FIG. 4
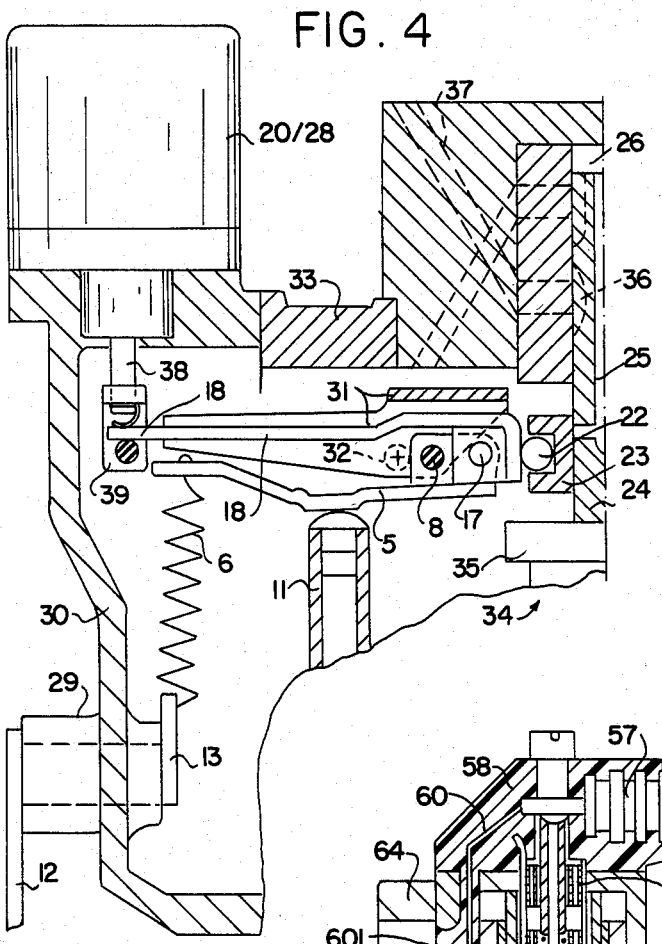
FIG. 5
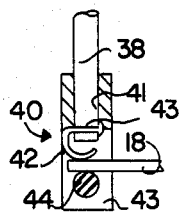
FIG. 6
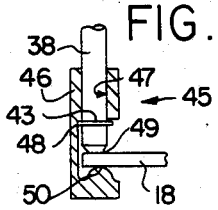
FIG. 7
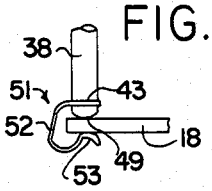
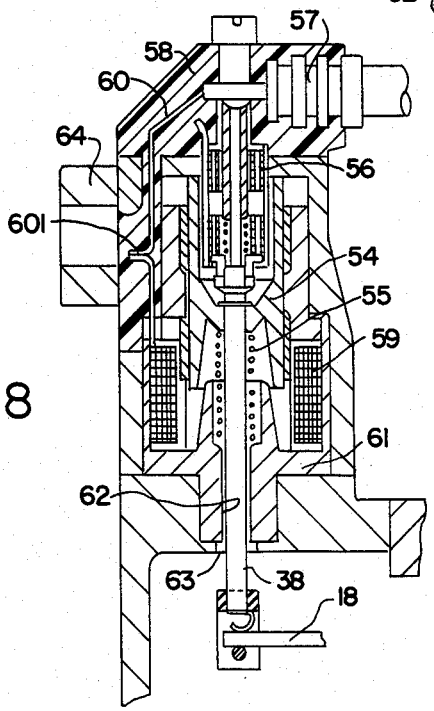
FIG.8

RPM GOVERNOR FOR FUEL INJECTION PUMPS

BACKGROUND OF THE INVENTION

The invention is directed to improvements in an rpm governor for fuel injection pumps. One problem with Diesel governors in general is how to control the relatively large adjusting forces that are required in such a way that when there are slight changes in such parameters as load, rpm, temperature and the like, it is still possible to effect a small change in the travel of the quantity control member and thus to finely regulate the injection quantity. This relationship among forces means that governor elements such as rpm signal transducers are relatively large, regardless of whether they operate by hydraulic or centrifugal means, and also that the governor springs are correspondingly strong, or in other words of large dimensions.

The relationship among the forces operative in such a governor, such as that between the spring force and a centrifugal force which has a completely different characteristic, makes it necessary to match these governor elements to one another in order to approach the ideal fuel consumption charactgeristic of the engine as closely as possible. Something which still seems to be relatively simple when considered in static terms becomes impossible when considered dynamically, because the adjusting forces fed into the governor, such as for rapidly adapting the injection quantity to what is actually required under conditions of abrupt load changes, depend much more on the rpm than on the actual load. On the other hand, overly rapid adjustments of fuel guantity cause the engine to react to the increased fuel quantity, which is appropriate for a higher load, by misfiring, which results in engine bucking or seesawing. A further factor is that the fuel consumption of the engine does not increase at all linearly with the rpm; instead, it decreases again at higher rpm, which is known to necessitate an adjustment of the injection quantity. It therefore becomes particularly difficult to add further control elements in such a governor, for taking other engine parameters such as air pressure into account. Although the use of a transmission lever having arms of different length between the quantity control member and the adjusting member (U.S. Pat. No. 4,519,352) substantially reduces the adjusting forces needed to intervene in the governor, nevertheless this is achieved at the expense of a long adjusting path for the adjusting member. For instance, if a pressure box is used as the adjusting member in this known governor, then the pressure box must be of such a size, that it will have adjusting path of the required length.

Electronically controlled Diesel governors are also known, which do have the advantage of processing the actual values of the various engine parameters very accurately, via an electronic control unit, into adjusting values for the quantity control member, but also have the disadvantage that if the electrical system fails, the entire fuel injection system is shut down as well, and on the other hand that the electrical output variables of the control unit must be converted into correspondingly large mechanical adjusting forces in order to actuate the quantity control member. A consequence of the latter disadvantage, particularly, is extraordinarily large and expensive rpm governors.

For this reason, rpm governors for injection pumps have been developed in which elastic governor elements such as springs are acted upon via electrical final control elements, so as to thereby vary the governor variable that sets the standard for the adjustment of the quantity control member (Japanese utility model application No. 59 939/81). However, these known governors have the disadvantage that an adjustment can be made in only one governor element at a time, using an associated electrical adjusting member.

OBJECT AND SUMMARY OF THE INVENTION

The rpm governor according to the invention has the advantage over the prior art that a set-point position of the quantity control member is attainable via electrical means, taking into account any possible actual engine parameters, using an electrical control unit; this position is attainable regardless of the particular operating position of the associated mechanical governor without intervening in the basic governor functions.

By means of the adjusting member, it becomes possible to use a governor, previously suited for only a limited number of engine types, for substantially more engine types, because the fine correction which is a major problem in adaptation with known governors can be effected quite simply via the electrical adjusting motor and the electrical control unit. Rapid changes in fuel quantity, which the mechanical governor seeks to effect, can thus be accommodated by permitting a delayed followup on the part of the quantity control member, in the sense that by using the electrical means in this way a slower change in the injection quantity is attained than would be the case with the mechanical governor, and thereby for instance preventing engine bucking.

According to an advantageous embodiment of the invention, the arms of the transmission lever are of different lengths, and the second arm, between the pivot shaft and the adjustment point of the adjusting motor, is longer than the first arm, preferably by a multiple factor. It is thereby advantageously attained that the force of the electrical adjusting motor is translated in accordance with the difference in lever arm length, and that furthermore the adjustment paths of the adjusting motor are readily controlled and very fine adjustments of the quantity control member, and thus of the injection quantity, are attainable.

According to a further embodiment of the invention, either a magnetically operating linear final control element having an inductive position transducer, or else an incremental final control element operating as a rotary adjuster, serves as the adjusting motor. For either type of adjusting motor, fuel from the injection pump can be used for cooling purposes. Both motors advantageously offer the opportunity of a relatively long adjustment path along with sufficiently large forces and small exterior dimensions.

In order to transmit the paths with the least possible mechanical tension or hysteresis, a coupling which is free of play and friction is disposed, in accordance with the invention and in a different embodiment, between the transmission lever and the adjusting member of the adjusting member.

The invention will be better understood and further objects and advantages thereof will become more apparent from the ensuing detailed description of a preferred embodiment and a variant thereof, taken in conjunction with the drawings.

BRIEF DESCRIPTION OF THE DRAWINGS

FIG. 1 shows the governor according to the invention in a schematic representation;

FIG. 2 shows an alternative form of final control element;

FIG. 3 is a fuel quantity and rpm function diagram for the governor shown in FIG. 1;

FIG. 4 is a cross sectional view of a structural embodiment of the essential parts of this governor;

FIGS. 5, 6 and 7 show three different types of coupling between the electrical adjusting motor and the adjusting lever;

FIG. 8 shows a linear magnetic final control element for this governor, in longitudinal cross section;

DESCRIPTION OF THE PREFERRED EMBODIMENT AND ITS VARIANT

Figure 9:
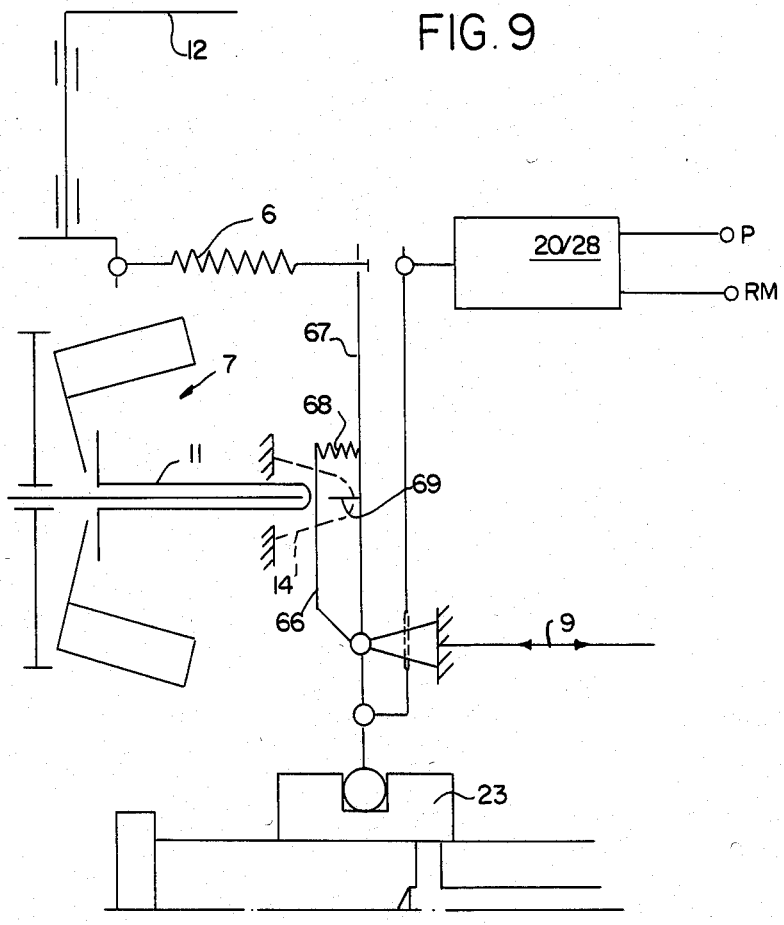
FIG. 9 shows a variant of the governor according to the invention, in a schematic representation.

The governor according to the invention comprises a conventional mechanical centrifugal rpm governor 1, which serves to determine the fuel injection quantity of a fuel injection pump 2 and in which an adjustment is made by electrical means 3 in order to correct the fuel quantity. The electrical means 3 are triggered by an electric control unit, not shown here, in which engine parameters of all types, such as rpm, temperature, load and load changes, air pressure, and so forth are processed.

In the mechanical governor shown in FIG. 1, a governor spring 6 engages a spring tensioning lever 5 counter to the force of an rpm signal transducer 7. The tensioning lever 5 is pivotable about a stationary shaft 8, the position of which can be adjusted in the direction of the arrow with respect to the governor housing via an adjusting device.

The rpm signal transducer 7 is driven at an rpm synchronized with the engine rpm, and flyweights 10 act upon an adjusting sleeve 11 which exerts a force that is proportional to the rpm upon the tensioning lever 5. The governor spring 6 which acts counter to this force can be varied in its initial tension, in particular arbitrarily, via an adjusting lever 12 by displacing an eccentric 13, on which one end of the governor lever 6 is suspended, via the adjusting lever 12; the other end of the governor lever 6 is connected to the tensioning lever 5.

While a load signal, for instance from the driver of the motor vehicle, is fed to the governor by means of the adjusting lever 12, an rpm signal that counteracts this load signal is fed by means of the rpm signal transducer 7. The position of the tensioning lever 5 is determined by the balance of these forces and by a full-load stop 14. The tensioning lever 5 is embodied with two arms, with the governor spring 6 and the rpm signal transducer 7 engaging the one arm 15 and a pivot shaft 17 of a transmission lever 18 being disposed at the end of the other arm 16. The transmission lever 18 is also embodied with two arms, having a first arm 19, which is engaged by an electric adjusting motor 20, and a second arm 21, which bears a driver ball 22 for a quantity control member 23 of the injection pump 2. This quantity control member 23 controls a poump work chamber relief bore 25, extending in a pump piston 24, so that depending on the position of the quantity control member 23 and the stroke position of the pump piston 24, after the injection of a specific quantity, the relief conduit 25 is opened up in order to interrupt the injection. The pump piston 24 is set into simultaneous reciprocating and rotary motion, as indicated by the arrows 27, by known means but not shown. While the reciprocation represents the actual pumping operation for the injection, which after an appropriate pumping stroke is interrupted by the quantity control member 23, the rotary motion, in this so-called distributor pump, serves to supply the various engine cylinders in succession with fuel, so that upon one revolution the pump piston 24 has as many compression strokes to execute as there are engine cylinders to be supplied with fuel.

The driver ball 22 and thus the quantity control member 23 follow up the movement of the pivot shaft 17 directly, and because of the relationship between the lengths of the first arm 19 and the second arm 21 of the transmission lever 18, only a certain reduction in the adjusting movement of the pivot shaft 17 is perceptible. An increasing rpm and thus increasing force of the adjusting sleeve 11, at constant load, causes a corresponding displacement of the quantity control member 23 toward the left and thus decreases the injection quantity by opening the relief conduit 25 earlier. Increasing load caused by rotation of the adjusting lever 12 (for instance by depressing the accelerator further) effects an increased initial tension of the governor spring 6 and thus, at constant rpm, effects a displacement of the quantity control member 23 toward the right, resulting in a correspondingly larger injection quantity. This injection quantity, corresponding to each tensioning lever position or load and rpm proportion, can be corrected by pivoting the transmission lever 18 about the pivot shaft 17 by means of the electrical adjusting motor 20. This correction of the injection quantity thus effects merely a change in the relative position of the quantity control member 23 and the tensioning lever 5; and this relationship remains until such time as it is changed in turn, in the form of a correction of the quantity effected by the electrical adjusting motor 20. The rpm governor 1 itself is not affected by this in terms of its function.

Because of the relative lengths of the arms 19 and 21, the arm 19 does not experience the force of the mechanical governor. Furthermore, relatively small forces of the electrical adjusting motor 20 suffice to perform the desired correction. The adjusting motor 20 may be embodied as a linear final control element, as shown in its various structural details in section in FIG. 8, or as a rotary final control element as shown in FIG. 2. In either case, even with this lever ratio relatively small travel paths suffice as a corrective means, so as to be able to effect the desired, usually very fine, adjustment in fuel quantity.

Referring now to FIG. 2, the rotary final control element 28 is preferably a stepping motor, which is less sensitive to vibration than a reciprocating final control element, in which the effects of accelerating mass are greater. In this figure, the rotary arm 29 of the rotary final control element 28 is also shown in broken lines in two pivoted positions; naturally, in order to attain a corresponding pivoting of the arm 19 of the transmission lever 18, the rotary final control element 28 must be rotated by 90° into the plane of the drawing. The connections P and RM of the respective adjusting motors 20 and 28 lead to the electrical control unit, not shown.

In the diagram shown in FIG. 3, which is intended especially to explain the possible range of correction attainable with the electrical means within the governor range of the mechanical governor, the injection quantity Q is plotted on the ordinate and the rpm n is plotted on the abscissa. With the electrical adjusting motor and the electrical control unit, a governor range A can be traversed, from a full-load characteristic curve I corresponding to a quantity Q1, to a characteristic curve II corresponding to a full-load quantity Q2, in order to take into account the various engine parameters. Furthermore, however, it is possible by means of the final control element, at starting rpm, to set an increased starting quantity Q3 represented by curve III, which is then corrected back to the smaller quantity Q2 after starting. This enlarges the correction range by the amount of section B. In any event, however, the injection quantity is regulated downward by the mechanical governor after the maximum rpm is reached, as shown by characteristic curve IV.

In FIG. 4, a detail which pertains to the governor of a distributor injection pump is shown in a structural embodiment, in cross section, so as to show the various details better than in the schematic representation of FIG. 1. The adjusting lever 12 and the eccentric 13 are disposed on the ends of a shaft 29, which is supported in the governor housing 30. The shaft 8 of the tensioning lever 5 is supported by an adjusting lever 31, which is pivotable about a shaft 32, so that upon pivoting, the adjustment indicated by the arrow 9 in FIG. 1 is attainable for the shaft 8. The shaft 32 is supported in a stationary manner in the pump housing 33. The movement of the pump piston 24 indicated by the arrows 27 of FIG. 1 is attained by means of the cam drive 34, with a stroke cam disk 35 rolling on rollers, not shown, which is joined in a known manner to the pump piston 24 for attaining its rotary and reciprocating motion. During the compression stroke, the relief conduit 25 communicates via a distributor groove 36, likewise disposed in the pump piston 24, with one of the pressure conduits 37, by way of which the fuel is carried to the engine and which correspond in number with the number of engine cylinders. As a result, communication between the pump work chamber 26 and one of the pressure conduits 37 is established during the compression stroke.

The adjusting motor 20/28, shown only in an exterior view, acts with an adjusting pin 38 upon the end of the arm 19 of the transmission lever 18. In order to obtain a play-free transmission of the adjusting movement of the adjusting pin 38, a corresponding coupling 39 is provided, which assures reliable transmission of even short paths of travel while touching the lever 18 over the least possible surface area. In FIGS. 5, 6 and 7 three variants of such a coupling are shown, on an enlarged scale. In the variant shown in FIG. 5, the coupling element 40 has a bore 41 receiving the adjusting pin 38, and to secure the coupling element 40 to the adjusting pin 38 a sheet-metal spring element 42 is used, which engages the inside of an annular groove 43 of the adjusting pin 38 and being curved toward the transmission lever 18 is thus arranged to rest thereon. The coupling element 40 has a recess 43 receiving the transmission lever 18, and in turn the recess 43 has a transverse pin 44 against which the lever 18 is pressed by the spring 42. As a result, there is a linear contact in the adjusting plane of the adjusting pin 38, between the lever 18 and the spring 42 and transverse pin 44, and the adjusting path of the adjusting pin 38 is transmitted without play.

In the second variant shown in FIG. 6, the coupling element 45 is embodied as a U-shaped clamp, one arm 46 of which has a bore 47 receiving the adjusting pin 38, and the adjusting pin 38 being secured by a retaining ring likewise engaging an annular groove 43. The front end 49 of the adjusting pin 38 is ball-shaped and rests directly on the lever 18. The rear side of the lever 18 is engaged by the second arm 50, which is ball-shaped toward the inside, of the U-shaped coupling element 45.

In the third variant shown in FIG. 7, the coupling element 51 is embodied merely as a sheet-metal spring clamp 52, which engages the annular groove 43 of the adjusting pin 38 and with one end 53, which touches the lever 18 only on a line, draws the lever 18 toward the ball-shaped end 49 of the adjusting pin 38. By this means as well, a play-free transmission of force is attained with line or point contact.

In FIG. 8, the electrical adjusting motor 20 is shown in simplified form, on a larger scale and in longitudinal section. This is a linear magnetic final control element, such as may be used for instance as the electrical means 3 of a governor as shown in FIG. 1. The adjusting pin 38 is displaced by the magnetic force of an armature 54 counter to the restoring force of a spring 55. If the electrical system is disrupted the arrangement may be such that the transmission lever 18 is pulled by the spring 55 into a position at which the supply quantity of the pump is adjustable to zero. Via an inductive position feedback 56, the adjusting pin position at a particular time and hence a quantity correction are fed into the electrical control unit. This position feedback 56 is injection molded to the end of a connection cable 57 through a plastic electrical connection element 58. The magnetic winding 59 is wired via lamellas 60, which are welded together at a junction point 601. The housing 61 of the electrical adjusting motor is flanged to the governor housing 30 (FIG. 4) in such a way that the adjusting pin 38 protrudes into the governor housing. A throttle gap 63 is provided in the bore 62 of the housing 61 that receives the adjusting pin 38, and by way of this gap 63 fuel can flow out of the governor housing, and hence out of the pump suction chamber, into the adjusting motor housing 61. By disposing a return line 64 for fuel on the housing 61, fuel constantly flows through the adjusting motor in order to cool it.

In the variant of the exemplary embodiment shown in FIG. 9, differing from the governor of FIG. 1, the tensioning lever is embodied in two parts, namely as a starting lever 66 and a drag lever 67. Both levers are pivotable about the shaft 8. Spaced apart from the shaft 8, a starting spring 68 is provided between the levers. As a result, an increased starting quantity can be attained by the mechanical governor, so that the electrical means for quantity correction are used only for other parameters, and the electrical adjusting motor suffices with substantially shorter required total adjusting paths.

After engine starting, only the starting lever 66 is initailly pivoted about the shaft 8 by the adjusting sleeve 11, whereupon the quantity control member 23 is displaced out of a position that generates an increased starting quantity and into a normal working position, and the starting spring 68 is compressed. Then as soon as the starting lever 66 abuts against a stop 69 of the drag lever 67, the two levers act as a unit, in the manner described for the tensioning lever 5 in FIG. 1. Here again, the force of the governor spring 6 acts counter to the force of the rpm signal transducer 7, and the guide variable is fed to this mechanical governor via the adjusting lever 12.

Figure 10:
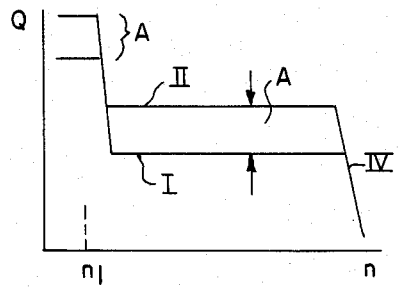
FIG. 10 is a fuel quantity and rpm function diagram for this variant.

For the quantity/rpm diagram shown in FIG. 10, which corresponds to that of FIG. 3, the only remaining necessary correction range is range A. While otherwise the characteristic curves I and II remain, the increased starting quantity generated by the mechanical governor always acts to attain an electrical quantity correction as represented by curve I at starting rpm, so that even at starting rpm, which extend as far as rpm $n_1$, the quantity correction A is effective.

The foregoing relates to a preferred exemplary embodiment of the invention and variants thereof, it being understood that other variants and embodiments thereof are possible within the spirit and scope of the invention, the latter being defined by the appended claims.

What is claimed and desired to be secured by Letters Patent of the United States is:

1. An rpm governor for fuel injection pumps of internal combustion engines, comprising a housing, an adjustable support, a tensioning lever having first and second arms each of which are pivotable about a stationary shaft in said housing supported on said adjustable support, said first arm of said tensioning lever being engaged by an rpm signal transducer counter to a variable force of a governor spring, a transmission lever including third and fourth arms arranged to pivot about a pivot shaft supported on said second arm of said tensioning lever, said pivot shaft further adapted to follow an adjusting movement of said tensioning lever, said third arm of said transmission lever arranged to transmit adjusting movement to a quantity control member of said injection pump and said fourth arm of said transmission lever arranged to be engaged by an adjusting member which further includes an electrical adjusting motor which serves to correct an injection quantity and said motor adapted to be triggered by an electrical control unit which possesses engine and environmental parameters.

2. An rpm governor as defined by claim 1, further wherein said tensioning lever further includes a short arm and a long arm, said pivot shaft being associated with said short arm, while said governor spring and said rpm signal transducer engage said longer arm.

3. An rpm governor as defined by claim 1, further wherein said third and fourth arms of said transmission lever are of unequal lengths and said second arm has a greater extent than said first arm.

4. An rpm governor as defined by claim 1, further wherein said tensioning lever comprises a starting lever and a drag lever, which are supported on said stationary shaft, and said drag lever further includes a stop means.

5. An rpm governor as defined by claim 1, further wherein said adjusting motor further includes a magnetically operating linear final control element having an inductive position feedback.

6. An rpm governor as defined by claim 1, further wherein said adjusting motor is an incremental final control element embodied as a rotary adjuster.

7. An rpm governor as defined by claim 2, further wherein said adjusting motor is an incremental final control element embodied as a rotary adjuster.

8. An rpm governor as defined by claim 3, further wherein said adjusting motor is an incremental final control element embodied as a rotary adjuster.

9. An rpm governor as defined by claim 4, further wherein said adjusting motor is an incremental final control element embodied as a rotary adjuster.

10. An rpm governor as defined by claim 5, further wherein said adjusting motor is affixed to said pump and/or governor housing so that fuel can flow through a housing arranged to support said adjusting motor.

11. An rpm governor as defined by claim 6, further wherein said adjusting motor is affixed to said pump and/or governor housing so that fuel can flow through a housing arranged to support said adjusting motor.

12. An rpm governor as defined by claim 1, further wherein said adjusting member is further provided with coupling means for frictionless engagement with said transmission lever.

13. An rpm governor as defined by claim 2, further wherein said adjusting member is further provided with coupling means for frictionless engagement with said transmission lever.

14. An rpm governor as defined by claim 3, further wherein said adjusting member is further provided with coupling means for frictionless engagement with said transmission lever.

15. An rpm governor as defined by claim 12, further wherein said coupling means is positively affixed to said transmission lever.

16. An rpm governor as defined by claim 15, further wherein said adjusting member is further provided with a terminal end portion having a ball-shaped contour, which engages said transmission lever.

17. An rpm governor as defined by claim 12, further wherein said transmission lever further includes a lower surface area and said coupling means has a portion adapted to engage said lower surface area.

18. An rpm governor as defined by claim 15, further wherein said transmission lever further includes a lower surface area and said coupling means has a portion adapted to engage said lower surface area.

* * * * *